US009470054B2

(12) United States Patent
Talgø et al.

(10) Patent No.: US 9,470,054 B2
(45) Date of Patent: Oct. 18, 2016

(54) PETROLEUM WELL INTERVENTION WINCH SYSTEM

(75) Inventors: Morten Talgø, Sandnes (NO); John Helvik, Stavanger (NO)

(73) Assignee: CAPWELL AS, Stavanger (NO)

( * ) Notice: Subject to any disclaimer, the term of this patent is extended or adjusted under 35 U.S.C. 154(b) by 399 days.

(21) Appl. No.: 14/235,410

(22) PCT Filed: Sep. 10, 2012

(86) PCT No.: PCT/NO2012/050171

§ 371 (c)(1),
(2), (4) Date: Jan. 27, 2014

(87) PCT Pub. No.: WO2013/036145

PCT Pub. Date: Mar. 14, 2013

(65) Prior Publication Data

US 2014/0174716 A1 Jun. 26, 2014

(30) Foreign Application Priority Data

Sep. 8, 2011 (NO) ..... 20111219

(51) Int. Cl.

| | |
|---|---|
| ***E21B 23/14*** | (2006.01) |
| ***E21B 33/03*** | (2006.01) |
| ***E21B 41/00*** | (2006.01) |
| ***E21B 41/06*** | (2006.01) |
| ***E21B 47/12*** | (2012.01) |

(Continued)

(52) U.S. Cl.

CPC ..... *E21B 23/14* (2013.01); *E21B 19/008* (2013.01); *E21B 33/037* (2013.01); *E21B 33/076* (2013.01); *E21B 41/0007* (2013.01); *E21B 41/06* (2013.01); *E21B 47/123* (2013.01)

(58) Field of Classification Search

CPC .. E21B 33/037; E21B 33/076; E21B 33/072; E21B 19/08; E21B 19/008; E21B 19/084; E21B 23/14; B66D 1/36; B66D 1/38; B66D 1/39; B66D 1/40; B66D 1/50; B66D 1/60; B66D 1/68

See application file for complete search history.

(56) References Cited

U.S. PATENT DOCUMENTS 1,370,458 A * 3/1921 Lindquist ..... B63C 7/06 114/53
2,810,439 A * 10/1957 McCullough ..... E21B 33/072 166/385

(Continued)

FOREIGN PATENT DOCUMENTS

| | | | |
|---|---|---|---|
| GB | 2 152 979 | A | 8/1985 |
| WO | WO 2006/027553 | A1 | 3/2006 |
| WO | WO 2010/131010 | A2 | 11/2010 |

*Primary Examiner* — Jennifer H Gay

(74) *Attorney, Agent, or Firm* — Birch, Stewart, Kolasch & Birch, LLP

(57) ABSTRACT

A petroleum well intervention winch system includes a high pressure confining housing for a drum for a rope to a tool string. The pressure confining housing has a connector with an aperture for the rope to a top of a tool string gate chamber on vertical bore BOP valves on a wellhead on the petroleum well. The rope runs through the aperture via a capstan to the drum. The capstan is driven by a first motor through a first high pressure proof magnetic coupling across a wall of the housing. The drum is driven by a second motor through a second high pressure proof magnetic coupling across the wall of the housing. The capstan is subject to a load tension from the rope and is provided with a hold tension on the rope from the drum. The second motor exerts a constant hold tension on the rope via the drum.

26 Claims, 10 Drawing Sheets

(51) Int. Cl.

| | |
|---|---|
| ***E21B 19/00*** | (2006.01) |
| ***E21B 33/037*** | (2006.01) |
| ***E21B 33/076*** | (2006.01) |

(56) References Cited

U.S. PATENT DOCUMENTS 3,415,317 A * 12/1968 Drivet ..... E21B 7/12 166/336
3,448,962 A * 6/1969 Miller ..... A01K 73/06 242/418
3,504,740 A * 4/1970 Manning ..... E21B 7/12 166/339
3,517,736 A * 6/1970 Waldron ..... E21B 33/076 166/351
3,889,307 A * 6/1975 Houot ..... B63B 22/06 367/133
3,968,954 A * 7/1976 Casco ..... B63B 21/16 242/225
4,577,693 A * 3/1986 Graser ..... E21B 33/076 166/338
4,686,927 A * 8/1987 Hawkes ..... B63C 11/52 104/173.1
5,280,879 A * 1/1994 Kreuter ..... B61B 12/10 254/333
7,703,534 B2 * 4/2010 Sheshtawy ..... E21B 7/124 166/302
8,613,310 B2 * 12/2013 Denoix ..... E21B 33/072 166/77.2
2010/0294479 A1 11/2010 Shee
2014/0174716 A1 * 6/2014 Talgo ..... E21B 33/037 166/65.1

* cited by examiner

PETROLEUM WELL INTERVENTION WINCH SYSTEM

INTRODUCTION

The present invention relates to a petroleum well intervention winch system. The system uses a bending flexible rope in order to provide reduced size of the drum and all sheaves and wheels over which the rope passes. The system includes all moving components confined in a high-pressure housing, and has a capstan drive for taking the load of the rope running with the toolstring in the well. The invention allows for a slender and robust vertically extending unit for being mounted on a toolstring gate chamber on a wellhead, the winch system for operating under well pressure when the access well is open.

BACKGROUND ART

There are traditionally two types of line used for wireline operations: so-called slick-line, and twisted conductor cable. In both types the line is fed into the well through a stuffing box with seals. The sealing devices create much friction towards the moving wireline both on its way into and out of the well. Further, the sealing devices are subject to wear and constitute a potential point of leakage from the well to the environment. Further still the sealing device must operate over a given length of the wireline with a rather steep pressure gradient along the given length, thus the sealing device will occupy at least the given length of the pressure gradient.

A winch assembly is described in US20100294479A1 published 25 Nov. 2010. It has a wire winch system subdivided into several chambers and with a direct-drive drum and diamond screw system and provided with a pipe system for the wire extending upwards from the housing to a sheave and down into the center of the housing to the toolstring.

BRIEF SUMMARY OF THE INVENTION

According to the invention, there is provided a petroleum well intervention winch system comprising a high pressure confining housing for housing a drum for a rope, the rope being connected to a tool string, said pressure confining housing having a connector with an aperture for said rope, the connector being coupled to a top of a tool string gate chamber on vertical bore BOP valves provided on a wellhead of said petroleum well, said rope running from said tool string through said aperture and via a capstan to said drum, said capstan driven by a first motor through a first high pressure proof magnetic coupling across a wall of said housing, said drum driven by a second motor through a second high pressure proof magnetic coupling across said wall of said housing, said capstan subject to a load tension from said rope from said tool string in said well, the rope provided with a hold tension from said drum, and said second motor exerting a constant hold tension on the rope via the drum.

BRIEF DESCRIPTION OF THE DRAWINGS

The invention is illustrated in the attached drawing figures, in which.

DETAILED DESCRIPTION

Figure 2:
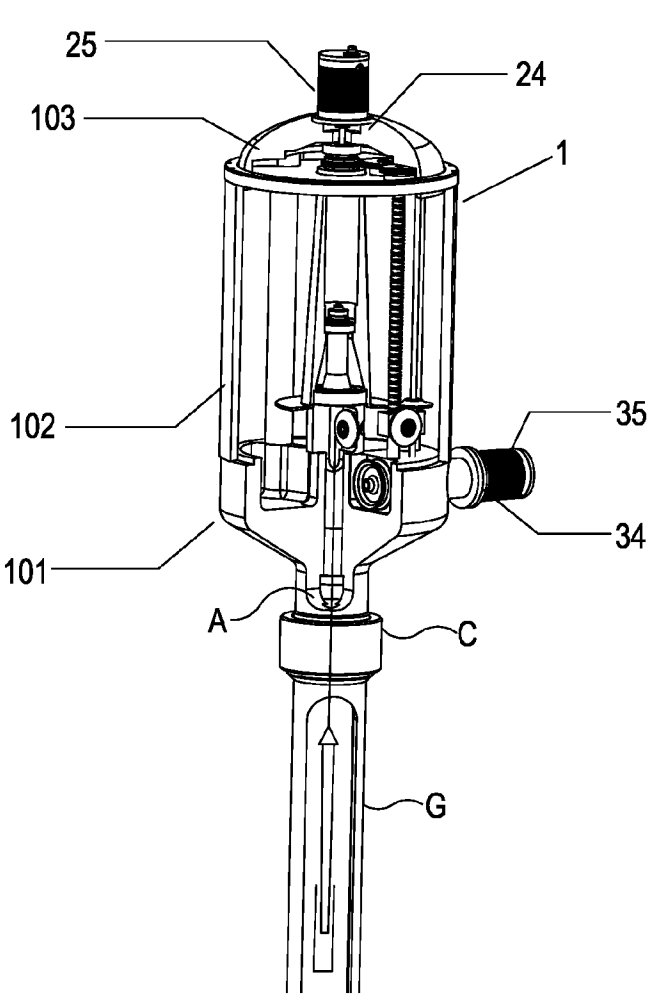
FIG. 2 is an enlarged view of the gate chamber with a tool string indicated.

A first and a second embodiment of the invention are shown in the drawings, wherein the first embodiment is an early embodiment of the invention showing a single capstan wheel and top and side motor drives on a high pressure housing, and the second embodiment of the invention showing a more mature embodiment with a dual capstan drive and both the capstan drive and the drum drive motors arranged with vertical axes under the lower part of the high pressure housing.

Figure 1:
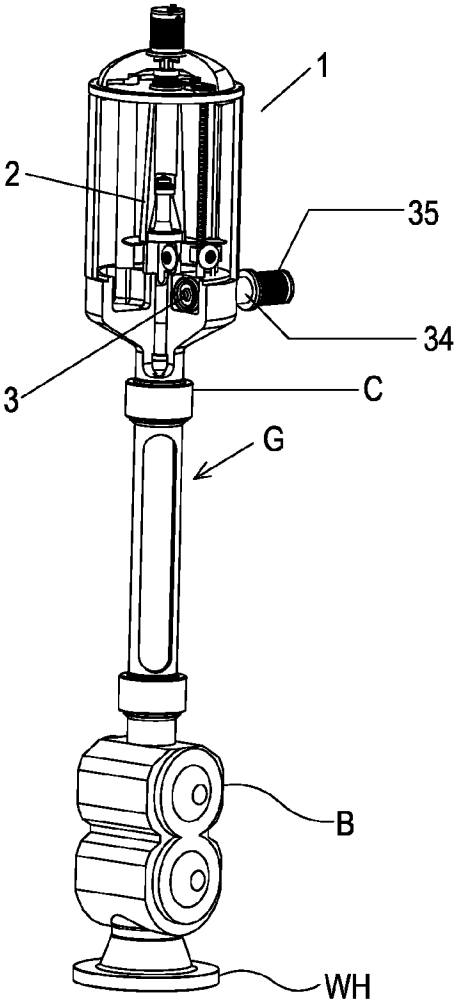
FIG. 1 is an isometric view of a gate chamber with a cutout view inside of a tool string inside, the gate chamber for being connected on top of a well, according to a first embodiment of the invention.

FIG. 1 is an isometric view of a gate chamber with a cutout view inside of a tool string inside, the gate chamber for being connected on top of a well. The housing of the first embodiment of the invention is mounted on top of the gate chamber. The gate chamber is mounted on top of vertical bore valves on top of the wellhead. The drum housing of the invention is shown in part section view. Note that the gate chamber is without any lubricator packer box.

Set out below are descriptive labels for certain reference numerals/letters as used in FIG. 1:

1: drum housing;
2: drum with vertical axis;
3: capstan;
35: first motor;
34: first magnetic coupling;
C: connector;

G: gate chamber (with cut-out part of wall for illustration purposes); and

B: BOP: vertical bore BOP valves on a wellhead WH.

FIG. 2 is an enlarged view of the gate chamber with a tool string indicated. The tool string is held in a rope running axially from the drum housing which will at the same pressure as the gate chamber's pressure. The rope has electrical or optical signal conductors.

Set out below are descriptive labels for certain reference numerals/letters as used in FIG. 2:

1: drum housing;
25: drum (second) motor;
24: drum (second) magnetic coupling;
101: base portion;
102: vertical cylinder portion;
103: dome portion;
35: first motor;
34: first magnetic coupling;
C: connector with aperture A for rope;
R: rope (or low-bending radius line with signal conductors);
G: gate chamber; and
T: tool string inside gate chamber (cut-out of wall for illustration only).

Figure 3:
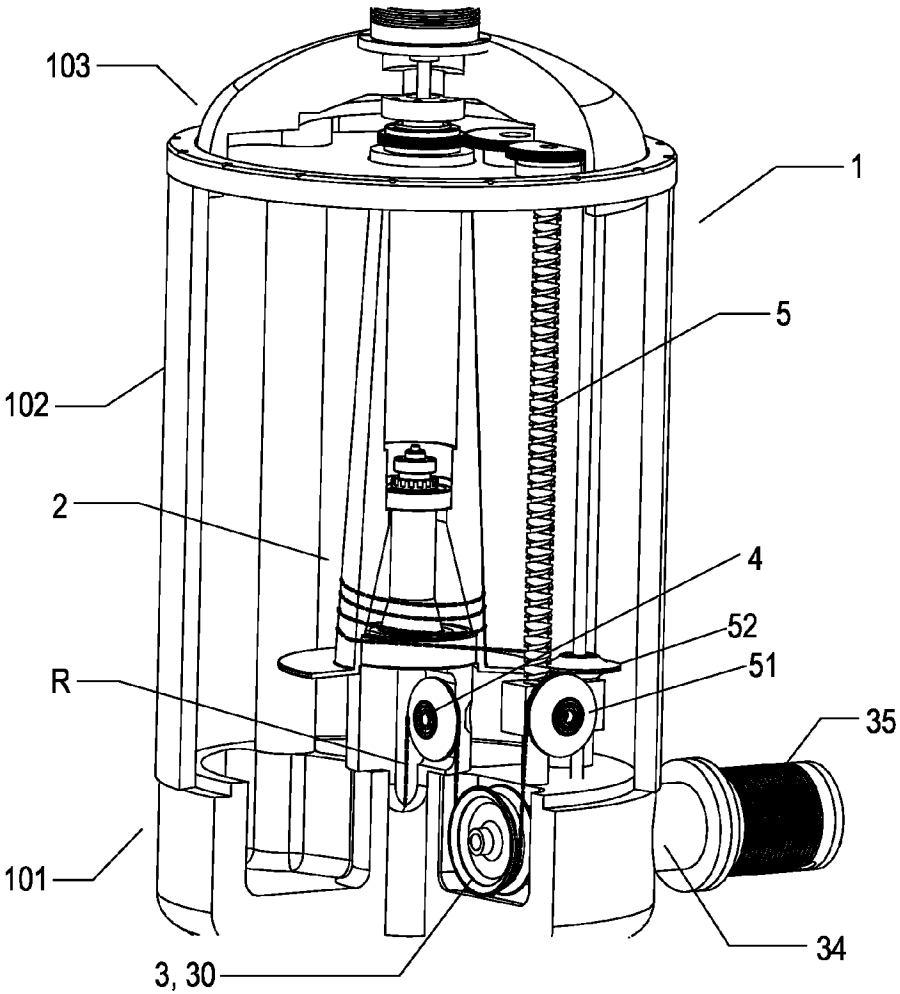
FIG. 3 is a closer view of details of the drum and the capstan and the rope guiding wheels within the pressure housing of the first embodiment of the invention.

FIG. 3 is a closer view of details of the drum and the capstan and the rope guiding wheels within the pressure housing of the first embodiment of the invention.

Set out below are descriptive labels for certain reference numerals/letters as used in FIG. 3:

1: house, HP resistant;
2: drum for rope;
3, 30: capstan wheel;
4: weight indicator/counter wheel;
5: diamond screw;
R: rope;
101: base portion;
102: vertical cylindrical portion;
103: dome portion;
35: first motor; and
34: first magnetic coupling.

Figure 4:
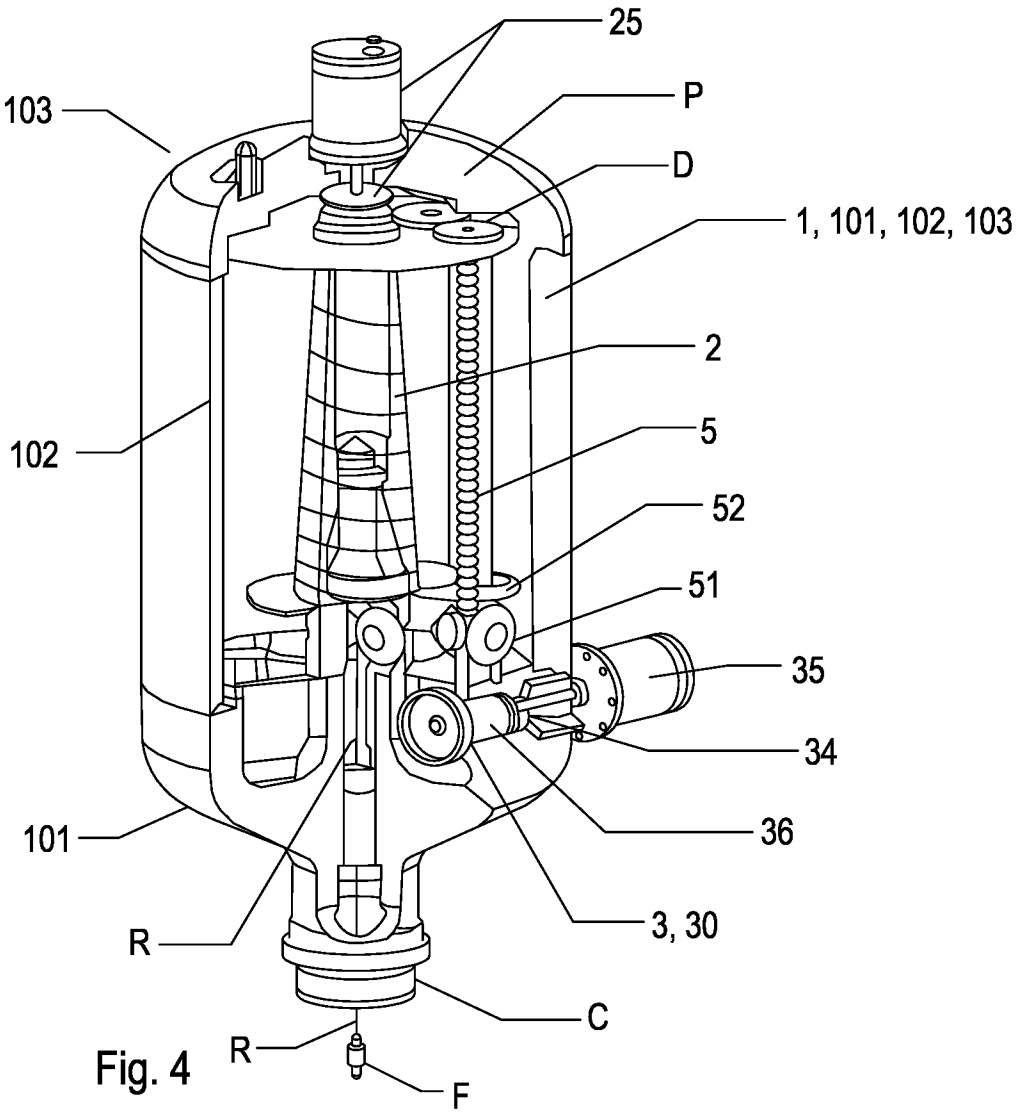
FIG. 4 is a perspective and partial section view of the pressure housing according to the first embodiment of the invention.

FIG. 4 is a perspective and partial section view of the pressure housing according to the first embodiment of the invention, showing on top a drum motor with a pressure proof magnetic drive coupling through the high pressure tank top for running the drum for the line and a diamond screw drive gear. The diamond screw has a shuttle with a horizontal guide wheel for laying the rope on the drum, and a vertical guide wheel for leading the rope to the capstan. The capstan is driven via a gear box and a pressure proof magnetic drive coupling through the tank wall and an external motor, which in this embodiment the capstan drive assembly has its axes horizontally aligned. At the bottom is shown a connector for the high pressure tank to the gate housing (please see FIGS. 1 and 2) with a rope to tool connector for providing mechanical and signal connection to the tool string.

Set out below are descriptive labels for certain reference numerals/letters as used in FIG. 4:

101: base portion;
102: vertical cylinder portion;
103: dome portion;
R: rope with signal conductors;
25: drum (second) motor with magnetic drive coupling;
P: high pressure tank top;
D: diamond screw drive gear;
1: high pressure tank cylindrical wall (101, 102, 103);
2: drum for rope or line R;
5: diamond screw;
52: horizontal guide wheel;
51: vertical guide wheel;
35: capstan (first) motor;
34: magnetic drive coupling;
36: capstan gearbox 1:10 gear ratio;
3, 30: capstan wheel (single)
C: connector to gate housing (tool insert chamber) on wellhead; and
F: tool connector.

In an embodiment of the invention there is arranged signal connectors through the wall of the pressure proof housing for signals to and from the rope wireline to the tool, and for a weight sensor and a depth counter.

Figure 5:
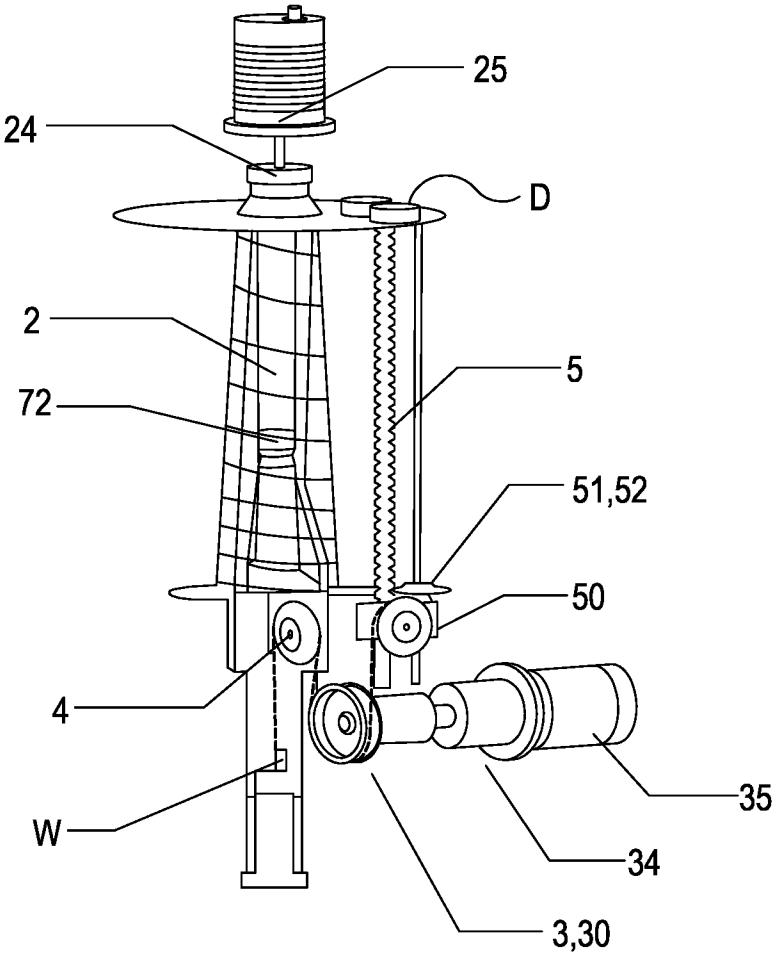
FIG. 5 is a perspective view similar to FIG. 4 of the internals of the first embodiment of the invention.

FIG. 5 is a perspective view similar to FIG. 4 of the internals of the first embodiment of the invention, with the tank removed from the illustration and showing the internal components and the constant torque motor drive on top and the horizontal motor drive for the capstan. A wiper for brushing off debris from the rope is shown in FIG. 5.

Set out below are descriptive labels for certain reference numerals/letters as used in FIG. 5:

25: constant torque motor;
24: magnet coupling;
D: gear;
2: conical drum;
5: diamond screw;
50: shuttle;
51, 52: guide wheels;
35: first motor;
34: first magnetic coupling;
3, 30: capstan with single wheel;
72: slip ring;
4: weight and depth indicator; and
W: wiper.

Figure 6:
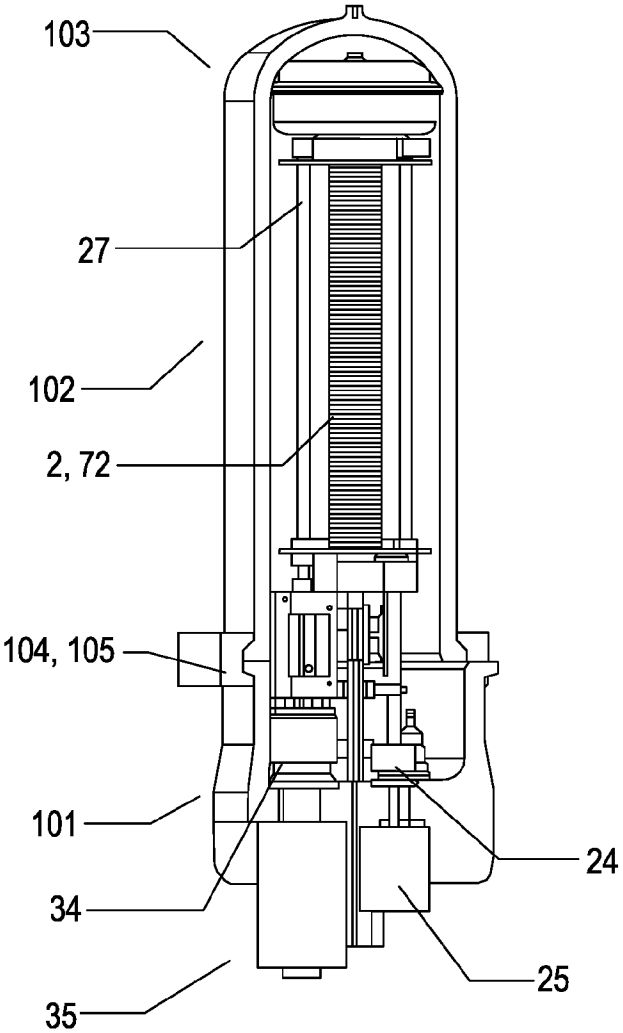
FIG. 6 is an elevation view and partial section view of a second embodiment of the invention with the motors arranged with vertical axes at the lower part of the housing.

FIG. 6 is an elevation view and partial section view of a second embodiment of the invention with the motors arranged with vertical axes at the lower part of the housing (1).

Set out below are descriptive labels for certain reference numerals/letters as used in FIG. 6:

103: dome portion;
27: drum and shuttle support bars;
102: vertical cylindrical portion;
2, 72: drum, slip ring (in 2);
104, 105: flange connection with locking ring;
101: base portion;
34: capstan (first) magnetic coupling;
35: capstan (first) motor;
24: second magnet coupling; and
25: drum (second) motor.

Figure 7:
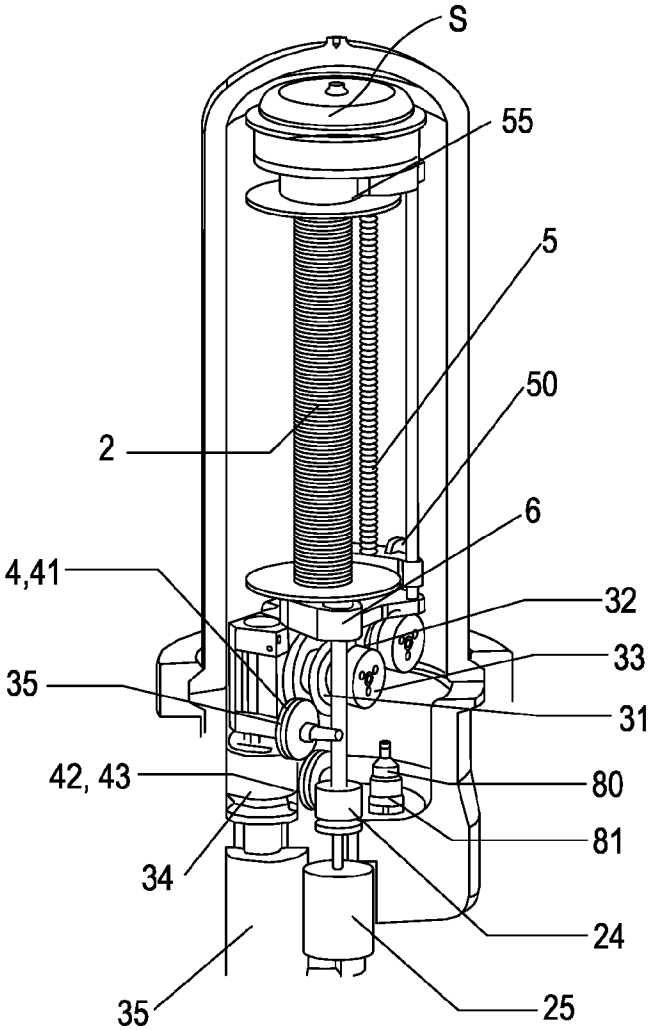
FIG. 7 is a perspective view with part section view of the second embodiment of the invention.

FIG. 7 is a perspective view with part section view of the second embodiment of the invention shown in FIG. 6. It provides a better overview of the relative positions of the components. The magnet couplings for the capstan drive, the drum motor drive and the signal connector bulkhead are arranged through the bottom of the housing, with axes parallel with the central opening for the rope to the gate housing below.

Set out below are descriptive labels for certain reference numerals/letters as used in FIG. 7:

S: pressure compensator;
55: gear box for diamond screw;
5: diamond screw;
50: shuttle;
6: drum gear;
2: drum;

4, 41: weight wheel with weight sensor 41;
35: capstan gearbox;
42, 43: depth counting wheel with counter;
34: capstan drive (first) magnetic coupling;
35: capstan (first) drive motor;
25: drum (second) motor;
24: second magnet coupling;
32: upper capstan wheel;
33: dual capstan sync. wh.;
31: lower capstan wheel;
80: signal connector; and
81: signal connector bulkhead.

FIG. 8 illustrates a vertical elevation view of the dual capstan drive of the second embodiment of the invention. An upper capstan wheel with guide grooves is arranged with a synchronizing belt drive from a lower capstan wheel also with guide grooves. The lower capstan wheel is connected horizontally through a capstan support block to a 90 degrees turn gear box with a magnetic drive coupling below to an underlying capstan drive motor also seen in FIGS. 6 and 7. The rope enters, as counted from below, from the high-pull side in the well via the load measurement sheave and/or the counting wheel to the load side of the dual capstan. The rope is laid in two, three or more turns, depending on the friction coefficient of a wet rope relative to the capstan wheels, over the dual capstan wheels, and the rope leaves to the hold side, also called the low-pull drum side. At the low pull drum side the rope is laid over a horizontal axis guide sheave and further to a vertical axis guide sheave, both arranged on the diamond screw driven shuttle block which distributes the rope on the drum in a pattern determined by the gear ratio of the diamond screw and the drum axis in the gear on top of the drum.

Set out below are descriptive labels for certain reference numerals as used in FIG. 8*b:*

25: second motor;
35: capstan (first) motor; and
34: capstan (first) magnet coupling.

Figure 8B:
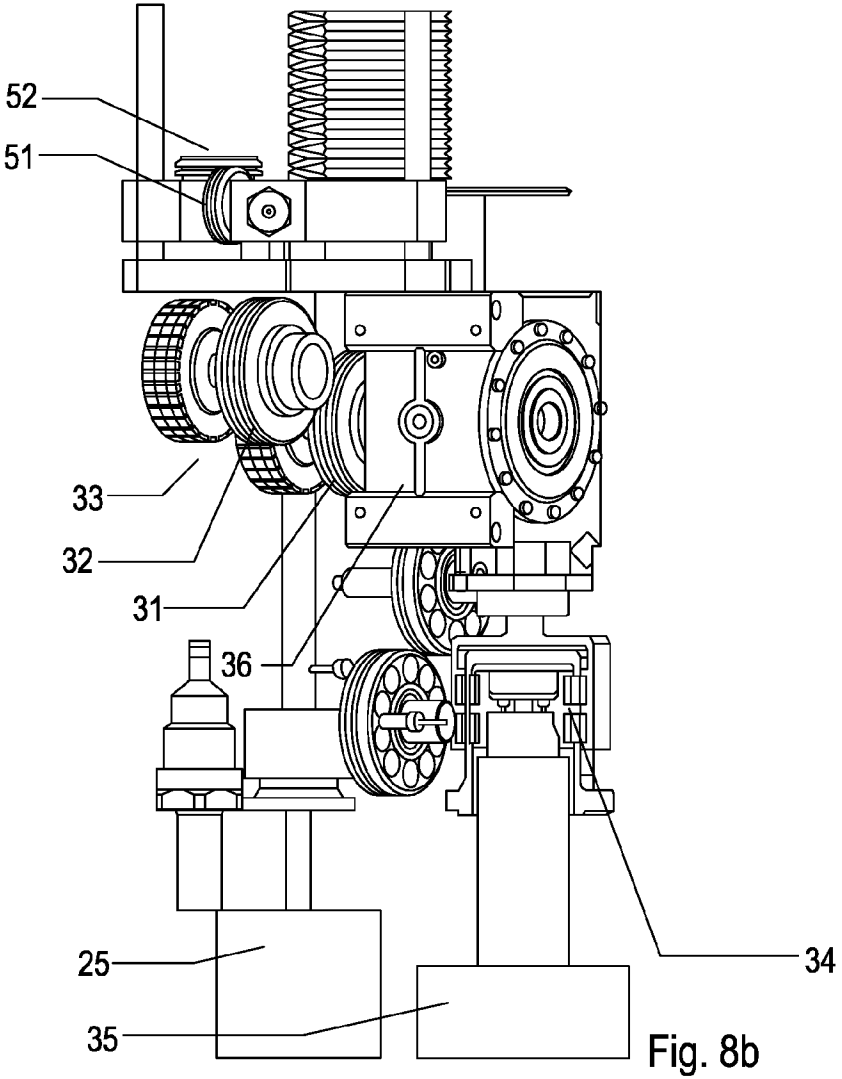
FIGS. 8*a* and 8*b* illustrate a vertical elevation view of the dual capstan drive of the second embodiment of the invention.
Figure 8A:
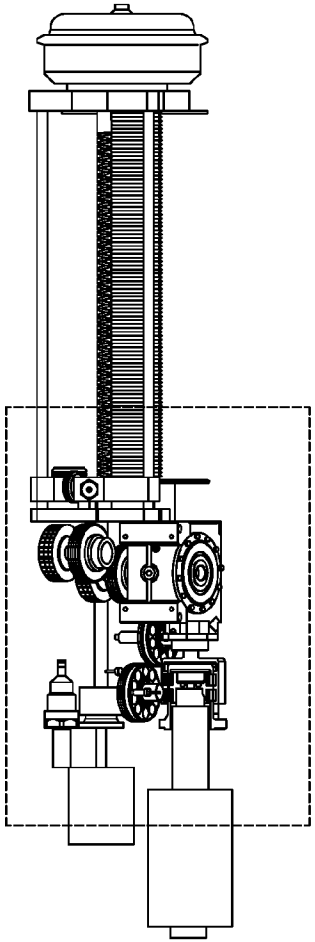

FIGS. 8*a* and 8*b*, further shows an upper guide sheave also shown in FIG. 7. The upper guide sheave is provided with a weight cell so as for measuring the load on the rope running in the well during lowering, standstill and hoisting. Further is shown a lower guide sheave which centers the rope on the well through the central hole best illustrated in FIG. 12*b*. This lower guide sheave is, in an embodiment of the invention, provided with a probe for detecting rotation movement of the sheave to indicate whether the sheave is registering the rope as feeding down or hoisting up. Further, the rotation speed may be calculated from the time rate of counts. In the embodiment shown in FIG. 7, five plugs of magnetic material may be placed in the holes between the sprockets of the lower sheave and with one or two magnetic sensor devices arranged static to register the magnetic signals from the turning sheave. In an embodiment the magnetic material on one side of the plugs may be slightly displaced compared to the magnetic material on the opposite side, thus enabling to detect which one of each pairs is leading, thus indicating lowering or hoisting of the rope. The rate of which the plugs are counted are used to calculate the speed of the lowering or hoisting.

A significant advantage of having a dual capstan wheel is that it allows multiple turns of the rope over the two wheels as oval loops so as for allowing the displacement from one grove on one capstan wheel to a subsequent groove on the opposite capstan wheel without incurring lateral displacement friction which would otherwise be incurred by a single capstan wheel. This significantly reduces wear on the rope during operation. The number of turns over the dual capstan wheels depends on the weight of the loading force from the toolstring, the hold force from the drum, the required maximum pulling force on the tool in the well and on the friction coefficient between the rope and the capstan wheels. Please notice that the friction coefficient may be rather low so the number of grooves prepared in each capstan wheel may be two or more up to six or seven. The synchronizing drive belt mechanism connecting the upper and lower capstan wheel may also comprise sprocket wheels with a chain, or a belt or gear. In the embodiment shown in FIGS. 7, 8, and 9 the capstan wheels should run the same direction, thus the belt or chain or gear.

Figure 9B:
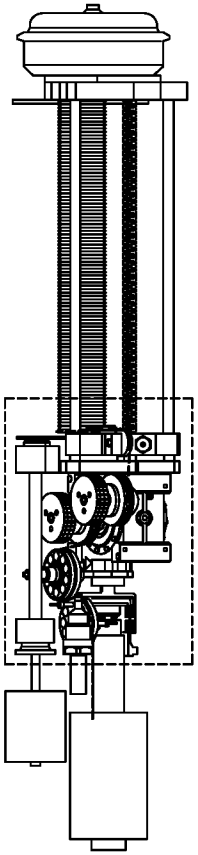
FIGS. 9*a* and 9*b* show in another perspective the same dual capstan drive as FIGS. 8*b* and 8*a;*
Figure 9A:
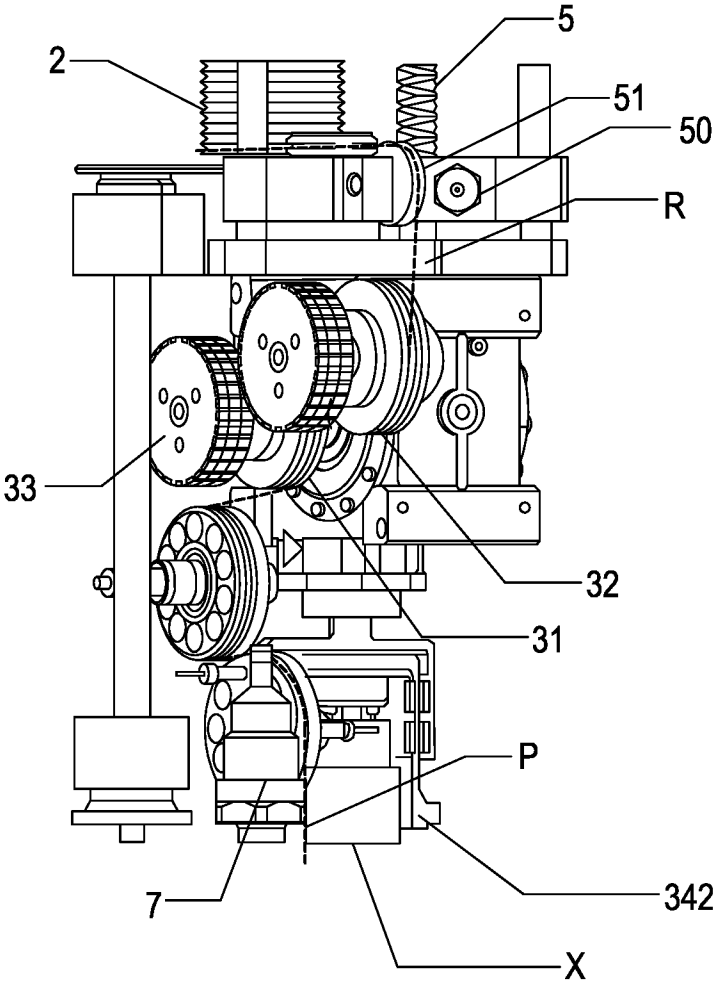

FIGS. 9*a* and 9*b* show in another perspective the same dual capstan drive as FIGS. 8*b* and 8*a*.

Set out below is a descriptive label for the reference letter X as used in FIG. 9*a:*

X: axle from 35: first motor.

Figure 10:
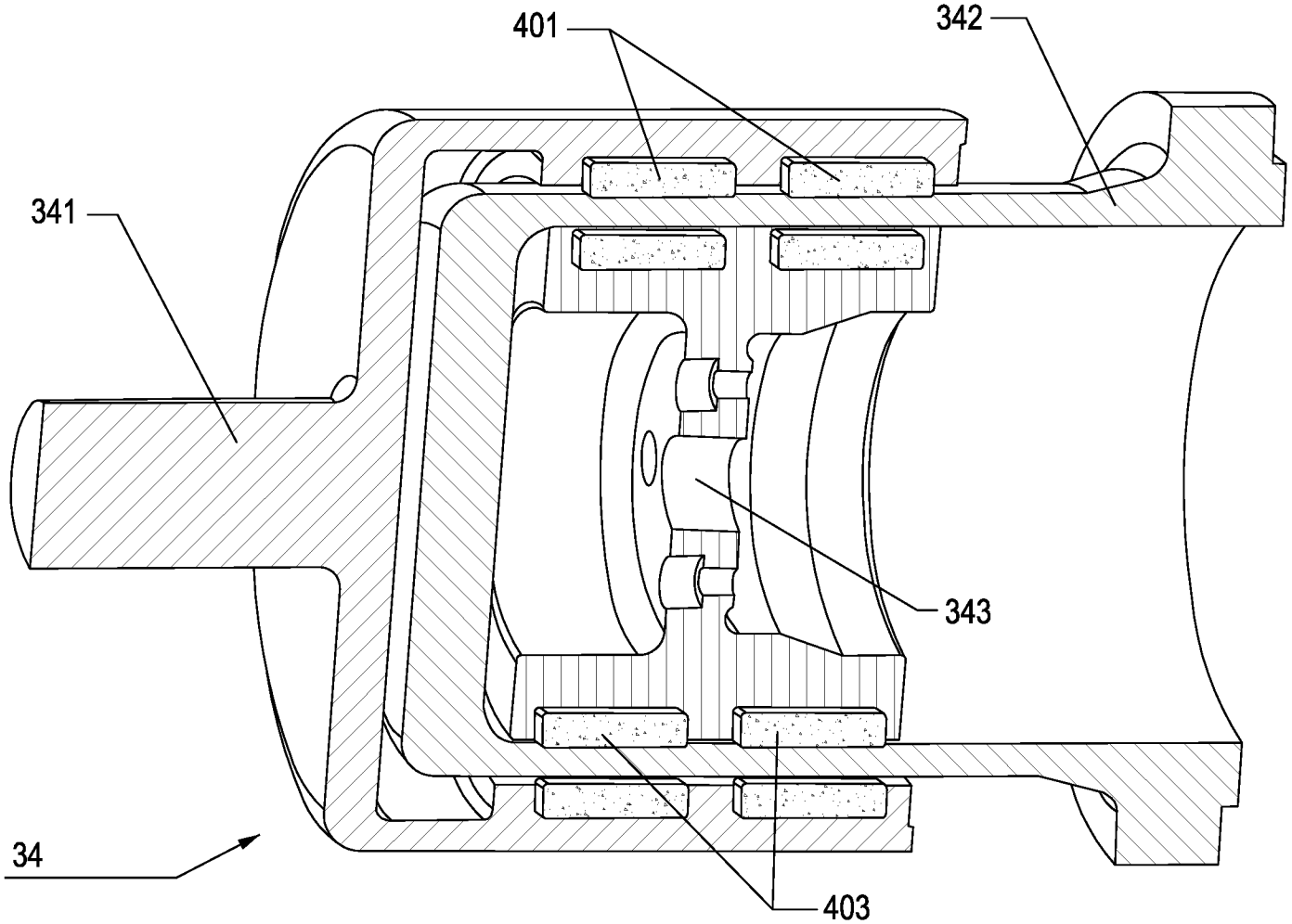
FIG. 10 is a sectional view of a pressure can for being integrated with the wall of the high pressure housing.

FIG. 10 is a perspective view and partial section view of a pressure can for being integrated with the wall of the high pressure housing, with an inner rotor for being connected to the external motor such as the capstan or the drum motors, and an outer rotor arranged at the internal, high pressure side within the high pressure housing. The magnet set at the inner rotor provides torque through the pressure can cylinder wall to the corresponding magnet set at the outer rotor which is further connected to run its corresponding equipment at the high pressure side. Thus a motor may easily be replaced without compromising the high pressure barrier. Further, with an external motor the heat from running the motor or braking using the motor is dissipated outside the high pressure proof housing, which may be arranged subsea or in open air.

Set out below are descriptive labels for certain reference numerals as used in FIG. 10:

34: capstan magnetic coupling;
341: outer rotor;
342: pressure can;
343: inner rotor (connected to 35: capstan motor side);
401: outer magnets; and
403: inner magnets.

Figure 11A:
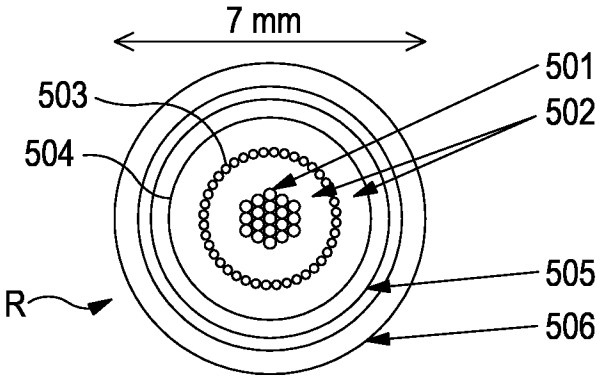
FIG. 11*a* illustrates in cross-section an example of the rope R.

FIG. 11*a* is an illustration of a cross-section of an embodiment of the rope R. In the invention a high strength, low elongation synthetic rope provided with conductors is used. It comprises an inner conductor bundle, an inner insulation layer of ethylene teraphtalate (EFTE), surrounded by an outer conductor layer. The outer conductor layer may function as a shield or a ground or a return current conductor layer. Outside this is a second ETFE-layer, followed by a contrahelical serving, a taped interleaving, and an outer braiding. The cable is so-called torque balanced in that its fibres are braided in a pattern so as for balancing any twist forces during tensioning or slackening. The application of such a torque-balanced and low bending radius rope signal cable allows the use of the present invention's small diameter guide wheels and relatively small capstan wheels, and also a low diameter drum. Together with the feature of the capstan being back-pulled by a constant torque driven drum the driving forces and the hoop stress on the drum will be relatively small, so the drum may be small and will not experience large forces, thus it may be designed rather light.

Set out below are descriptive labels for certain reference numerals/letters as used in FIG. 11*a:*

R: 7 mm synthetic fibre cable rope (R) with electrical conductors in centre and ground shield. Torque-balanced, will not twist under axial tensioning or slackening;

501: inner conductor;

502: insulation layers (EFTE: Ethylene tetrafluorethylene);

503: outer conductor (shield);

504: contrahelical serving;

505: taped interleaving; and

506: outer braiding (Technora).

Figure 11B:
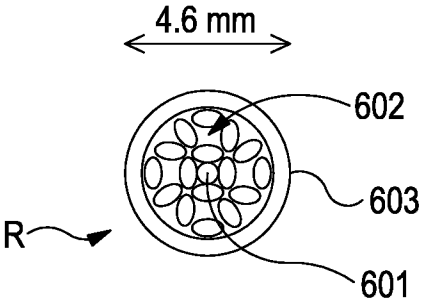
FIG. 11*b* illustrates in cross-section another example of the rope R.

In FIG. 11*b* is shown another cable rope (R) which is relevant for use with the system of the invention; a 4.6 mm ϕ optical fibre cable rope with an optical fibre bundle in the centre, four synthetic-fibre strands, and a partially open braided jacket. The bending radius is 96 mm and the cable strength is 24 kN.

Set out below are descriptive labels for certain reference numerals/letters as used in FIG. 11*b:*

R: 4.6 mm synthetic fibre cable rope (R) with optical conductors in the centre;

601: optical fibre bundle;

602: four synthetic fibre strands; and

603: braided jacket, partially open.

Figure 12C:
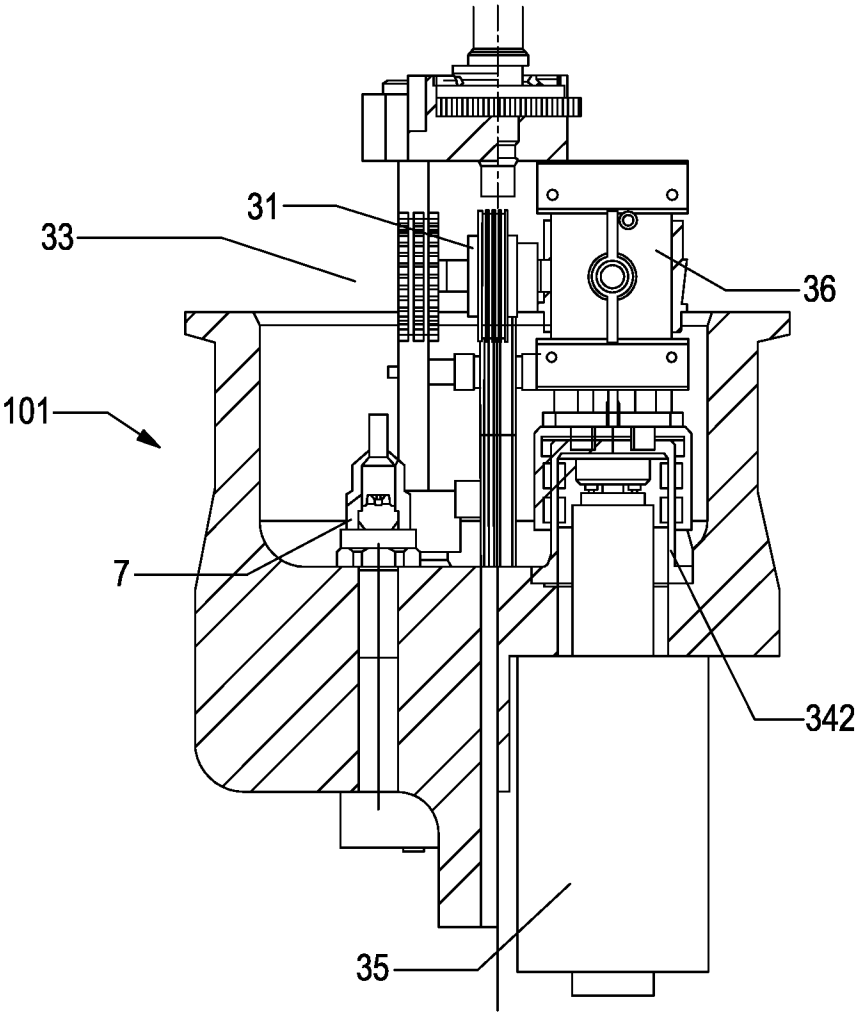
FIG. 12*c* is a vertical section view of the lower part of the housing as seen from the left side of FIG. 12*b* along the section line II-II.
Figure 12A:
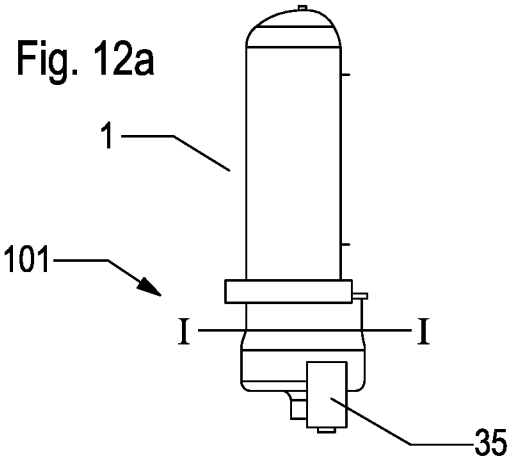
FIG. 12*a* is an elevation view of the housing of the second embodiment of the invention.

FIG. 12*a* is an elevation view of the housing (1) from another direction than the elevation view and partial section view of the second embodiment of the invention shown in FIG. 6.

Figure 12B:
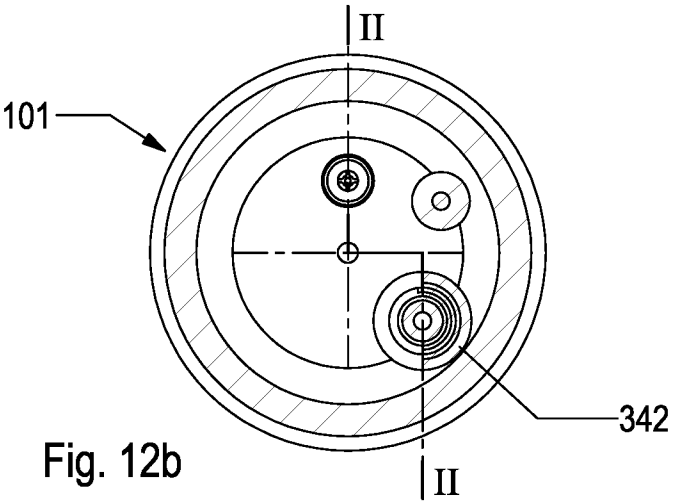
FIG. 12*b* is a horizontal section and partial view of the housing in the elevation shown by the line I-I of FIG. 12*a*.

FIG. 12*b* is a horizontal section and partial view of the housing (1) in the elevation shown by the line I-I of FIG. 12 *a*. Sections of the magnet couplings of the capstan and drum motor drives are shown in the right part and the section and also a section of the signal connector bulkhead are through the bottom of the housing, with the central opening for the rope shown in center.

FIG. 12*c* is a vertical section view of the lower part of the housing (1) as seen from the left side of FIG. 12*b* along the section line II-II through the signal connector bulkhead and the capstan drive motor, magnet coupling and gear box, all of which are shown in perspective in FIG. 7.

EMBODIMENTS OF THE INVENTION

The invention is a petroleum well intervention winch system comprising a high pressure confining housing (1) for a drum (2) for a rope (R) to a tool string (T). The pressure confining housing (1) has a connector (C) with an aperture (A) for said rope (R) to a top of a tool string gate chamber (G) on vertical bore BOP valves on a wellhead (WH) on the petroleum well. The rope from said tool string (T) runs through the aperture (A) via a capstan (3) to the drum (2). Please see FIGS. 2, 4 and 5 for a first embodiment of the invention having one single-wheel capstan (3), and FIGS. 6, 7 and 8 for a second embodiment having a dual-wheel capstan (3, 31, 32).

The entire system provides that the drum and all moving parts are encapsulated in a pressure compartment (1) which is equalized with the well pressure before operation starts and during the operation. This eliminates the need for stuffing boxes and seals around the line and hence significantly reduces potential risks of leakage.

High pressure in the present context is defined as up to 1100 Bar, which is the maximum pressure expected in a well. Higher pressures may be actual under some operational conditions and must be considered in each particular operation depending on the actual well. The tool string (T) is for logging, mechanical operation, or well intervention, and may comprise logging instruments, intervention tools, and a tractor for running in deviated wells.

The capstan (3) is driven by a first motor (35) through a first high pressure proof magnetic coupling (34) across a wall of said housing (1), please see FIGS. 4, 6, 7, 8, and 10.

The drum (2) is driven by a second motor (25) through a second high pressure proof magnetic coupling (24) across said wall of said housing (1), please see FIGS. 2, 4, 5, 6, 7, 8 and 9.

According to a central aspect of the invention, the capstan (3) is subject to a load tension from the rope (R) from the tool string (T) in the well and provided with a hold tension on the rope (R) from the drum (2), and the second motor (25) exerting a constant hold tension on rope (R) via the drum (2), or a constant torque on the drum (2), which amounts much the same). More specifically, said second motor (25) exerts a constant torque on the drum (2) at least when hauling said rope from said well. It may also operate with the same torque while lowering the tool. Thus the capstan takes the load from the tool string in the well, the drum takes the significantly lower hold tension on rope (R).

According to an embodiment of the invention the constant torque on the drum motor is due to an electronic control of its corresponding drum motor in that the electronic control maintains a constant torque irrespective of the motor running the drum for lowering out to or hauling in the rope to the capstan, which is run by a separate capstan motor. In this embodiment the drum motor keeps a desired tension at the low tension side of the capstan irrespective of whether the capstan lowers out or hauls in cable from the well. This is the reason for having two separate motor drives wherein the capstan drive motor exerts the relatively heavier work for hoisting the rope with the tool upwards in the well, and keeps the load on any drive component above the capstan low.

The aperture (A) for the rope (R) has a diameter allowing the rope to pass rather freely and allowing the pressure confining housing (1) to have substantially the same pressure as the well when the BOP valves are open. Thus there is no pressure gradient lubricator operating on the rope such as otherwise used between a wireline or CT injector and the gate chamber for the tool string.

The rope (R) is flexible in bending and has a small bending radius, and may be provided with one or more electric or optical signal lines and one or more electric power conductors.

In an embodiment of the intervention winch system of the invention, the drum (2) has a vertical axis, as shown in FIGS. 1-10.

In an embodiment of the intervention winch system the high pressure confining housing (1) is vertical cylindrical with said connector (C) with said aperture (A) for said rope (R) in the bottom portion, as illustrated in FIGS. 6 and 7.

In an embodiment of the intervention winch system of the invention the rope (R) is laid over a weight wheel (4) with a weight sensor (41) measuring the tension from said rope (R) with said tool string (T), please see FIGS. 2, 3, 4, and 7. The weight wheel (4) runs freely only controlled by the rope (R) and thus holds the tension from the rope and the tool string. In an embodiment of the invention the rope (R) is laid over a depth counting wheel (42) provided with a counter 43) for measuring the length of rope extended into the petroleum well, please see FIG. 5 wherein the two functions are combined into one single sheave indicated as "Weight and depth indicator". Further, please see FIGS. 7 and 8 *b*, 9 *a* for a separate depth counting wheel.

In an embodiment of the invention there is arranged a high pressure proof signal connector bulkhead (7) in said high pressure confining housing (1), please see FIGS. 8 *b*, and 7 for conducting at least sensor signals from said weight sensor (41) and said depth counter (43). Advantageously the connector bulkhead (7) is arranged vertically and in a lower portion of said high pressure confining housing (1).

According to an embodiment of the invention the first magnetic coupling 34) has a vertical rotation axis and arranged in a base portion (101) of the high pressure confining housing (1). Advantageously also the second magnetic coupling (24) has a vertical rotation axis and arranged in a base portion (101) of the high pressure confining housing (1).

According to a first the invention the capstan (3) comprises a first, single capstan wheel (30), please see FIG. 4. According to a second embodiment of the invention, please see FIGS. 7 and 8 and 9, the capstan (3) is a so-called dual capstan and comprises a first and a second capstan wheel (31, 32). The second capstan wheel (32) is driven by a chain, gear or belt transmission (33) from the first capstan wheel (31). The chain of the chain transmission (33) is not illustrated in FIGS. 8 *b* and 8 *c* due to clarity.

The first and second capstan wheels (31, 32) have parallel axes and are preferably generally co-planar, please see FIGS. 6, 7, 8, 9, and 12 *c*.

The first and second capstan wheels (31, 32) may be provided with parallel grooves so as for guiding and separating turns of said rope (R). The effect of the grooves is to guide the rope (R) around the capstan wheels (31, 32) and to avoid lateral climbing of the rope (R). The rope is allowed to shift from one groove on one wheel to a subsequent groove on the next wheel. It is only required that this takes place once each complete round, else there will be an empty groove between the turns.

In embodiments of the invention, as shown in FIGS. 4, 8, and 12 *c* there is a first reduction gear (36) between said capstan (3) and said first magnetic coupling (34) to said first motor (35). Advantageously the system is provided with a second reduction gear (26) between said drum (2) and said second magnetic coupling (24) to said second motor (25), please see FIG. 7.

In an embodiment of the invention the first reduction gear 0 has a first, horizontal axle driving said capstan (3) and a second, vertical axis driven via said first magnetic coupling (34) from said first motor, please see FIG. 7 and FIG. 12*c*.

In the two embodiments shown in FIGS. 1 to 4 and in FIGS. 6 and 7, the pressure confining housing (1) is subdivided into a base portion (101) and a vertical cylindrical portion (102) with a dome top (103). In the embodiment shown in FIGS. 6 and 7, the vertical cylindrical portion (102) and the dome top (103) constitute an integral unit for being sealed to the base portion (101). This provides that the housing (1) has only one place for splitting, and thus only one place for sealing. Preferably there is a metal-to metal seal between the two parts. This simplifies the design for obtaining a truly pressure-proof housing (1). In the embodiment shown in FIGS. 6 and 7, the base portion (101) and the vertical cylindrical portion (102) are connected by an external flange connection (104) with a locking ring (105).

In an advantageous embodiment of the invention the base portion (101) holds the capstan (3), the first magnetic coupling (34) and the first motor 35); and in a further advantageous embodiment also the drum (2) with the second magnet coupling (24) and the second motor (25). In the embodiment shown in FIG. 7 the motors are arranged extending from below into recesses in the base portion (101), they are thus protected from anything dropped from above, thus making the system less vulnerable.

In an advantageous embodiment of the invention the base portion (101) holds the signal line bulkhead connector (7), please see FIGS. 7 and 12 *c*.

According to the first and second embodiment of the invention the drum (2) is provided with a parallel connected diamond screw (5) with a shuttle (50) with a horizontal axis sheave (51) for guiding said rope (R) from said capstan (3) and a vertical axis sheave (52) for guiding said rope (R) to said drum, please see FIGS. 3, 4, 5, 7, 8 *b* and 9 *a*. The drum is driven by the second motor (25) via drum gear (26). The drum then drives a diamond screw gear box (55) on top, which drives the diamond screw.) The diamond screw shuttle (50) slides on shuttle support bars (27) extending parallel with the drum (2).)

In an advantageous embodiment of the invention the first motor (35) is arranged replaceably externally on the ambient pressure side of the first magnet coupling (34). This facilitates particularly repair if the motor (35) should fail or otherwise need to be replaced, particularly when the housing is under internal pressure, and the well intervention needs not to be interrupted. This also reduces the risk of loss and incurred fishing of the intervention tool string.

In order to take off signals between the rope (R), which may be provided with signal conductors and for electrical power conductors, the rope (R) comprising one or more electrical signal conductors connected via a slip ring (72) of the rotating drum (2) to a static takeoff connected further to said bukhead connector (7) so as for allowing communication between the tool string in said well and equipment at the ambient pressure side of said housing (1), please see FIGS. 5 and 6.

The rope (R) may comprise one or more optical signal conductors. The optical signal conductors are connected at the drum to an optical to electrical signal converter further connected to the bulkhead connector (7).

For the magnetic coupling (34) it is illustrated in FIG. 10. It comprises a cylindrical pressure can (342) forming a high pressure barrier integrated in the wall of the high pressure housing (1), preferably mounted metal to metal in the wall, wherein the first magnetic coupling comprises an inner rotor (343) with inner magnets exerting magnetic forces across the wall of the cylindrical pressure can 343) to outer magnets of a cylindrical outer rotor (341) at the high pressure side, wherein the outer rotor (341) further is connected directly or indirectly via said first gear box (36) to the capstan (3).

The second magnetic coupling (24) is made with a similar but smaller design as it shall only take smaller torques.

On top of the drum to diamond screw gear mechanism there is arranged an oil pressure compensator. The oil pressure compensator shown is of the bellows-type, but it could as well have been of the piston type. The purpose of the hydraulic compensator is for compensating for the oil volume reduction when the pressure varies between ambient pressure of 1 Bar before introduction of the wireline tool in the gate housing before the vertical bore valves below the gate valves are opened, to a maximum well pressure of 1100 Bar when the vertical bore valves below the gate housing are open and the wireline tool operates in the well. The pressure compensator also compensates for the heat expansion of the oil when the gears are running and the oil is increased to its operating temperature.

As an alternative to said rope, which has a small bending radius, there may be a wire or slickline with small bending radius. One of the significant advantages of having a small bending radius is that the radius of the drum may be made comparably small and thus the confining house may be designed with a small diameter, reducing the weight and size of the entire unit. The width of the entire housing (1) in the second embodiment shown here is about 0.6 m, and the height of the housing is about 1.4 m. One of the advantages of using a rope with signal conductors is the fact that it is very flexible to bend and thus requires little torque to wind up onto the drum. Thus the drum motor may be rather small.

The invention claimed is:

1. A petroleum well intervention winch system comprising:

a high pressure confining housing for housing a drum for a rope, the rope being connected to a tool string, said pressure confining housing having a connector with an aperture for said rope, the connector being coupled to a top of a tool string gate chamber disposed on vertical bore BOP valves on a wellhead of said petroleum well, said rope running from said tool string through said aperture and via a capstan to said drum, said capstan driven by a first motor through a first high pressure proof magnetic coupling across a wall of said housing, said drum driven by a second motor through a second high pressure proof magnetic coupling across said wall of said housing, said capstan subject to a load tension from said rope from said tool string in said well, the rope being provided with a hold tension from said drum, and said second motor exerting a constant hold tension on said rope via said drum.

2. The intervention winch system of claim 1, wherein said drum has a vertical axis.

3. The intervention winch system of claim 1, wherein said high pressure confining housing is vertical cylindrical, said aperture being positioned in a bottom portion of said high pressure confining housing.

4. The intervention winch system of claim 1, wherein said rope is laid over a weight wheel with a weight sensor measuring the tension applied from said rope and tool string.

5. The intervention winch system of claim 1, wherein a length of said rope extends into the petroleum well and said rope is laid over a depth counting wheel provided with a counter for measuring the length of the rope extended into said petroleum well.

6. The intervention winch system of claim 1, comprising a high pressure proof, signal connector bulkhead in said high pressure confining housing for conducting sensor signals at least from a weight sensor and from a depth counter.

7. The intervention winch system of claim 6, wherein said connector bulkhead is arranged vertically and in a lower portion of said high pressure confining housing.

8. The intervention winch system of claim 1, wherein said first magnetic coupling has a vertical rotation axis and is arranged in a base portion of said high pressure confining housing.

9. The intervention winch system of claim 1, wherein said second magnetic coupling has a vertical rotation axis and is arranged in a base portion of said high pressure confining housing.

10. The intervention winch system of claim 1, wherein said second motor exerts a constant torque or tension on said drum at least when hauling said rope from said well.

11. The intervention winch system of claim 1, wherein said capstan comprises a first capstan wheel.

12. The intervention winch system of claim 1, wherein said capstan comprises a first capstan wheel and a second capstan wheel.

13. The intervention winch system of claim 12, wherein said second capstan wheel is driven by a chain, a gear or a belt transmission from said first capstan wheel.

14. The intervention winch system of claim 12, wherein said first and second capstan wheels have parallel axes and are generally co-planar.

15. The intervention winch system of claim 12, wherein said first and second capstan wheels are provided with parallel grooves for guiding and separating turns of said rope.

16. The intervention winch system of claim 1, further comprising a first reduction gear between said capstan and said first magnetic coupling.

17. The intervention winch system of claim 16, further comprising a second reduction gear between said drum and said second magnetic coupling.

18. The intervention winch system of claim 17, wherein said first reduction gear has a first, horizontal axle for driving said capstan and a second, vertical axle driven via said second magnetic coupling by said second motor.

19. The intervention winch system of claim 1, wherein said high pressure confining housing is sub-divided into a base portion and a vertical cylindrical portion with a dome top.

20. The intervention winch system of claim 19, wherein said base portion holds: said capstan, said first magnetic coupling, said first motor, said drum with said second magnet coupling, and said second motor.

21. The intervention winch system of claim 19, wherein said base portion holds a signal line bulkhead connector.

22. The intervention winch system of claim 1, wherein said drum is provided with a parallel connected diamond screw with a shuttle with a horizontal axis sheave for guiding said rope from said capstan and a vertical axis sheave for guiding said rope to said drum.

23. The intervention winch system of claim 1, wherein said first motor is arranged replaceably externally on an ambient pressure side of the first magnet coupling.

24. The intervention winch system of claim 1, wherein said rope comprises one or more electrical signal conductors connected via a slip ring of said rotating drum to a static takeoff connected further to a bulkhead connector for allowing communication between the tool string in said well and equipment at an ambient pressure side of said housing.

25. The intervention winch system of claim 1, wherein said rope comprises one or more optical signal conductors.

26. The intervention winch system of claim 1, wherein said first magnetic coupling comprises a cylindrical pressure can forming a high pressure barrier integrated in a wall of said high pressure housing, said first magnetic coupling comprising an inner rotor with inner magnets exerting magnetic forces across a wall of said cylindrical pressure can to outer magnets of a cylindrical outer rotor at a high pressure side, and wherein said outer rotor is further connected directly or indirectly, via a first gear box, to said capstan.

* * * * *